US007272332B2

(12) United States Patent
Kitagawa et al.

(10) Patent No.: US 7,272,332 B2
(45) Date of Patent: Sep. 18, 2007

(54) IMAGE FORMING APPARATUS AND DENSITY CORRECTION DATA CREATION METHOD USED THEREIN

(75) Inventors: Takashi Kitagawa, Yamatokoriyama (JP); Mitsuru Tokuyama, Soraku-gun (JP); Toshiaki Ino, Soraku-gun (JP); Kiyofumi Morimoto, Tenri (JP); Yasuhiro Nishimura, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 148 days.

(21) Appl. No.: 11/158,675

(22) Filed: Jun. 21, 2005

(65) Prior Publication Data

US 2005/0281573 A1 Dec. 22, 2005

(30) Foreign Application Priority Data

Jun. 21, 2004 (JP) ..... 2004-182689

(51) Int. Cl.
*G03G 15/00* (2006.01)

(52) U.S. Cl. ..... 399/49; 399/72

(58) Field of Classification Search ..... 399/49, 399/72, 9, 60; 347/19, 115; 358/406, 504, 358/298

See application file for complete search history.

(56) References Cited

U.S. PATENT DOCUMENTS

| | | | | |
|---|---|---|---|---|
| 5,873,011 | A * | 2/1999 | Takemoto et al. | 399/49 |
| 6,061,533 | A | 5/2000 | Kajiwara | |
| 6,288,733 | B1 * | 9/2001 | Nakazawa et al. | 399/49 X |
| 2002/0098005 | A1 * | 7/2002 | Takeuchi et al. | 399/49 |
| 2005/0117928 | A1 * | 6/2005 | Hino | 399/49 |

FOREIGN PATENT DOCUMENTS

| | | |
|---|---|---|
| JP | 10-198088 | 7/1998 |
| JP | 11-160926 | 6/1999 |
| JP | 2002-335401 | 11/2002 |

* cited by examiner

*Primary Examiner*—Sophia S. Chen
(74) *Attorney, Agent, or Firm*—David G. Conlin; Steven M. Jensen; Edwards Angell Palmer & Dodge LLP

(57) ABSTRACT

An image forming apparatus is arranged such that one reference test pattern image expressed in a tone expression is formed on the predetermined image bearing member, the tone expression being different from a tone expression of an image formed in the print modes that carry out a normal print process, and density of the formed reference test pattern image is detected, and subsequently sets of density correction data for the print modes are created based upon the detected density.

14 Claims, 5 Drawing Sheets

DENSITY CORRECTION DATA CREATION PROCESS

IMAGE FORMING APPARATUS AND DENSITY CORRECTION DATA CREATION METHOD USED THEREIN

This Nonprovisional application claims priority under 35 U.S.C. § 119(a) on Patent Application No. 182689/2004 filed in Japan on Jun. 21, 2004, the entire contents of which are hereby incorporated by reference.

FIELD OF THE INVENTION

The present invention relates to an image forming apparatus having a density correction function that corrects printing density so as to conform with density of input images, and in particular, relates to an image forming apparatus that creates sets of density correction data based upon density of a test pattern image supported (formed) on a certain image bearing member (forming member), the sets of density correction data for respective print modes used in the density correction function, and to a density correction data creation method.

BACKGROUND OF THE INVENTION

Conventionally, in image forming apparatus, such as a copying machine, a density correction process has been carried out to read-in image data so as to conform (i) a density of a printed image that is actually printed out with (ii) a density of image data of a document that is read in from a device, such as a scanner. This density correction process is generally carried out by using, for example, a method in which a quantity of correction predefined based upon precedently created density correction data is added/subtracted to/from the read-in image data.

Meanwhile, there is a problem that the density of the printed image that is printed out based upon the image data to which the density correction process is precedently carried out does not conform with the density of the input image (for example, document image) as a result that sensitivity of a photosensitive drum changes due to various factors, such as changes over time in sensitivity characteristic of the photosensitive drum, changes of environmental temperatures, or other factors. Therefore, the density correction data used in the density correction process have to be updated at certain timing.

An example of such density correction data updating method is disclosed in the Japanese Patent Application Publication No. 2002-335401 (published on Nov. 22, 2002) (hereinafter, referred to as published art). In this method, test patterns for tone process modes are formed in different regions on one transfer material (sheet) and are developed. Subsequently, the formed and developed test patterns are read in, and the density correction data are created based upon this read-in results.

In addition, there is another method that has been known (termed as conventionally-known-art). In this method, one test pattern is formed on a certain image bearing member, the one test pattern being for one of a plurality of tone processes that are carried out when a normal image formation motion is carried out. Then, density of this test pattern is detected. Based upon this detected density value, density correction data applicable to the above-mentioned tone process is created. Subsequently, by shifting this density correction data at a certain shifting quantity, sets of density correction data respectively applicable to the other plurality of tone processes are created.

Neither the published art nor the conventionally-known-art considers inaccuracy in measuring density, the inaccuracy caused by the tone expression of the test patterns formed on a transfer material or on an image bearing member. The test patterns are usually expressed with a tone expression expressed in the respective tone processes. In either of the arts in which test patterns expressed in such tone expression are used for creating density correction data, the image data of the read-in test patterns would possibly be inaccurate in count of dots (dot count) and in measured density. Therefore, either of the arts has a problem in that there is no confidence level in their density corrections because appropriate density correction data cannot be expected as described above. Especially, because a number of dots is extremely few in a highlighted section in test patterns, measurement in a quantity of toner adhered in the highlighted section tends to be inaccurate, and therefore the density correction data lacks confidence level in terms of the highlighted section. In other words, because the inaccuracy in the dot count and in measured density occurs significantly in the highlighted section in the read-in images of the test patterns, the confidence level of the density correction data corresponding to the highlighted section decreases further than the other section of the image.

SUMMARY OF THE INVENTION

In view of the above situations, an object of the present invention is to provide (i) an image forming apparatus that can increase a confidence level of density correction data corresponding to a highlighted section so as to achieve an appropriate density correction process, and (ii) a method for creating density correction data.

In order to achieve the object, an image forming apparatus and creation method for creating density correction data according to the present invention are arranged such that one reference test pattern image expressed in a tone expression is formed on the predetermined image bearing member, the tone expression being different from a tone expression of an image formed in the print modes that carry out a normal print process, and density of the formed reference test pattern image is detected, and subsequently sets of density correction data for the print modes are created based upon the detected density.

With this arrangement, in which the test pattern image expressed in the tone expression in which inaccuracy less likely occurs (i.e. which allows more accurate detection), it becomes possible to increase the confidence level of the created density correction data and to achieve an appropriate density correction process.

Other aims, features, and merits of the present invention should be sufficiently understandable with the following descriptions. In addition, advantages of the present invention should be clear with the following explanation with reference to the attached drawings.

DESCRIPTION OF THE EMBODIMENTS

Followings describe embodiments of the present invention with reference to the attached drawings for better understanding of the present invention. The following embodiments are merely concrete examples of the present invention and do not limit the technical scope of the present invention.

Figure 1:
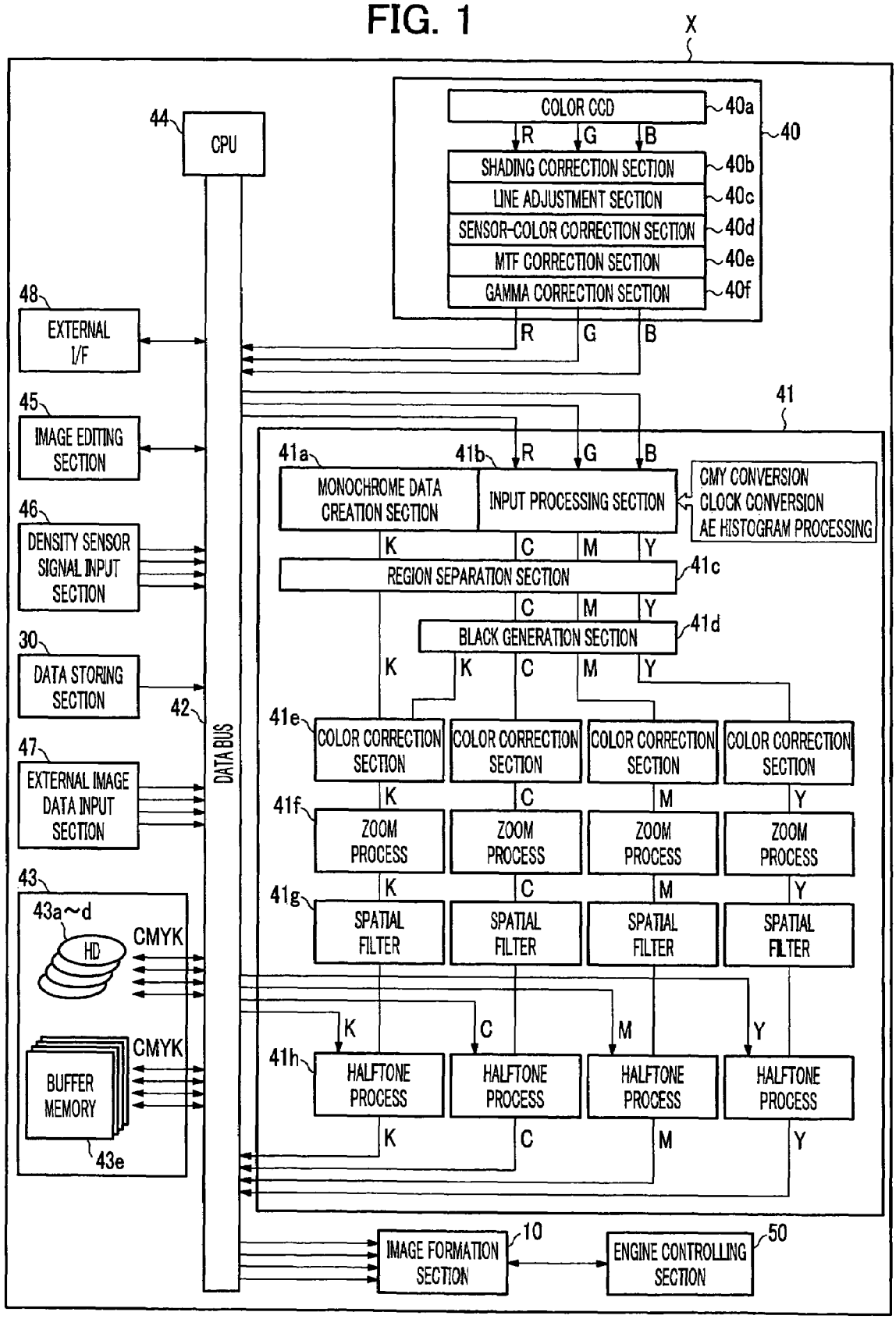
FIG. 1 is a block diagram that schematically illustrates a structure of a color copying machine X and a control system according to an embodiment of the present invention.
Figure 2:
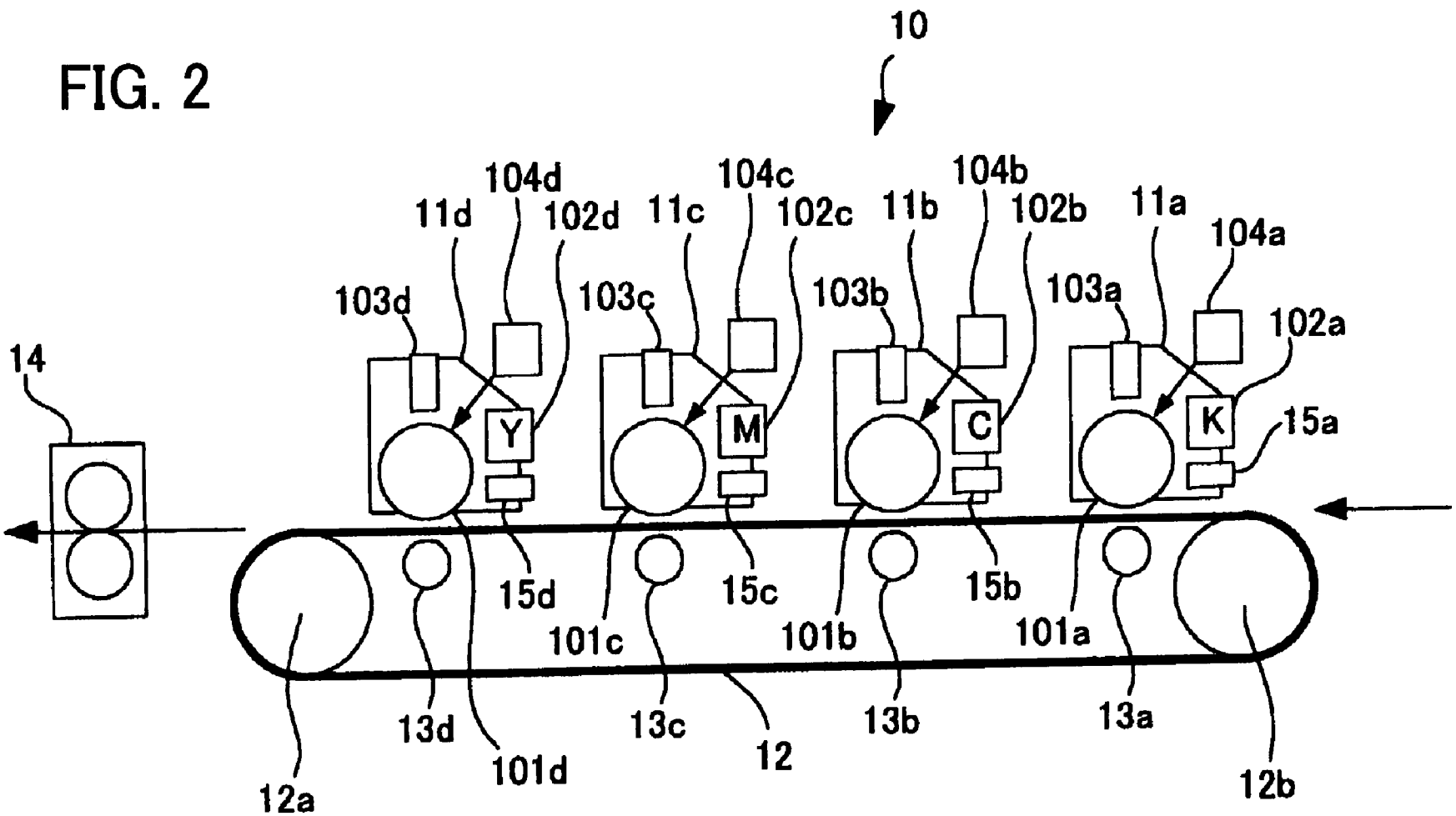
FIG. 2 is a sectional view schematically illustrating an image formation section 10 of the color copying machine X according to the embodiment of the present invention.
Figure 3:
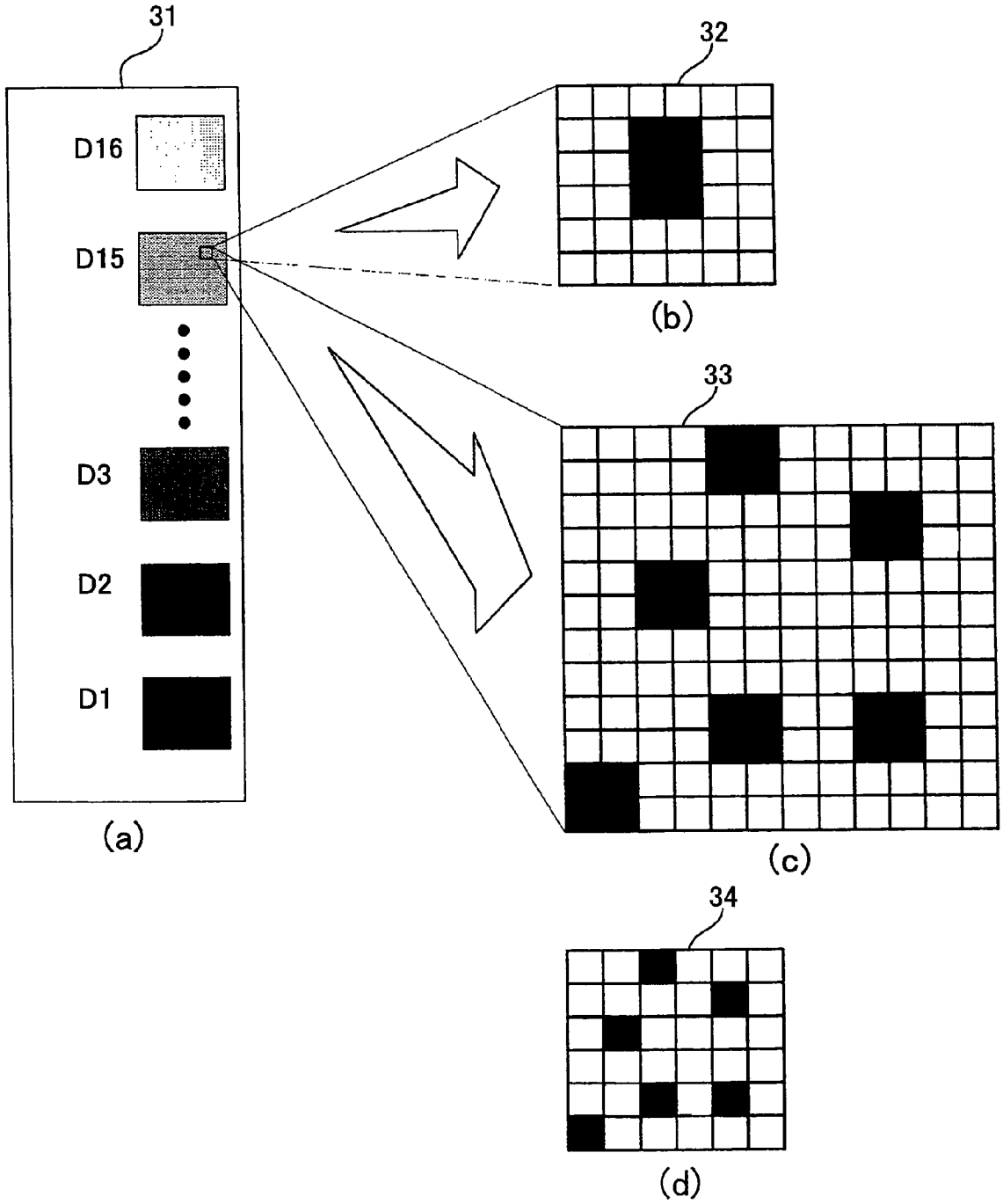
FIG. 3 is a view illustrating a reference test pattern and a tone expression of the reference test pattern.
Figure 4:
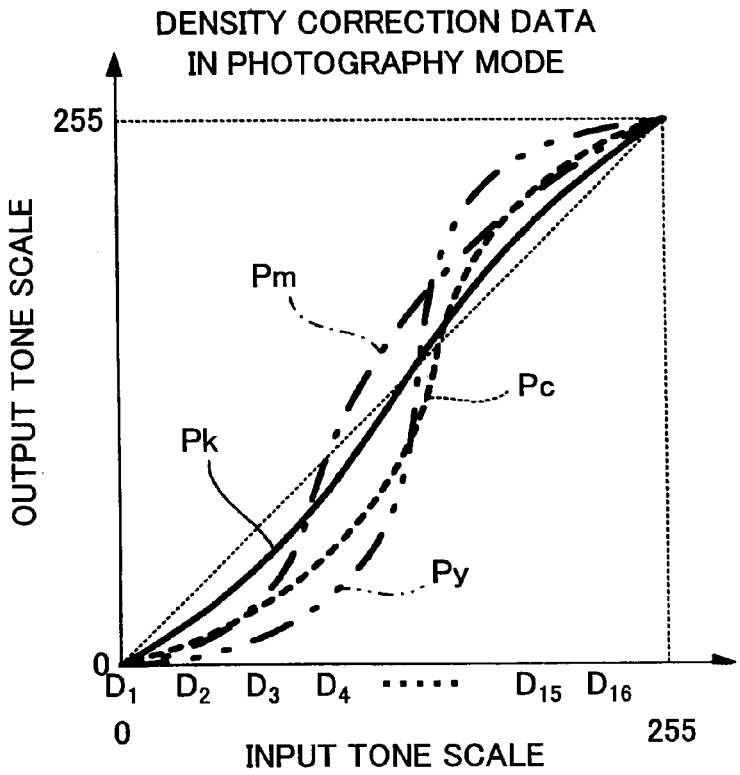
FIG. 4(*a*) and FIG. 4(*b*) are graphs that illustrate density correction data used in a density correction data process for photographic image data.
Figure 4:
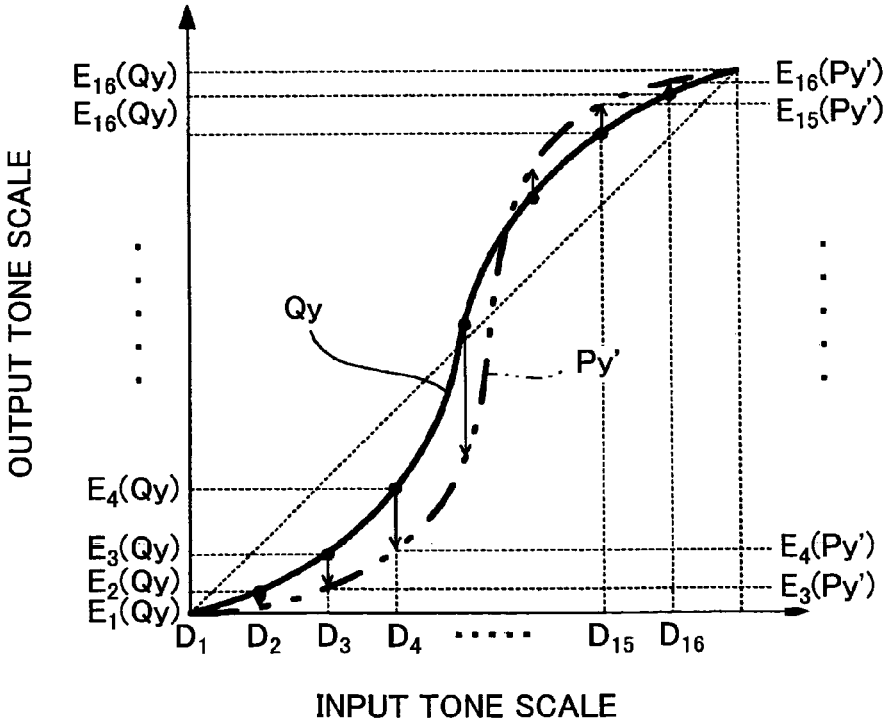
Figure 5:
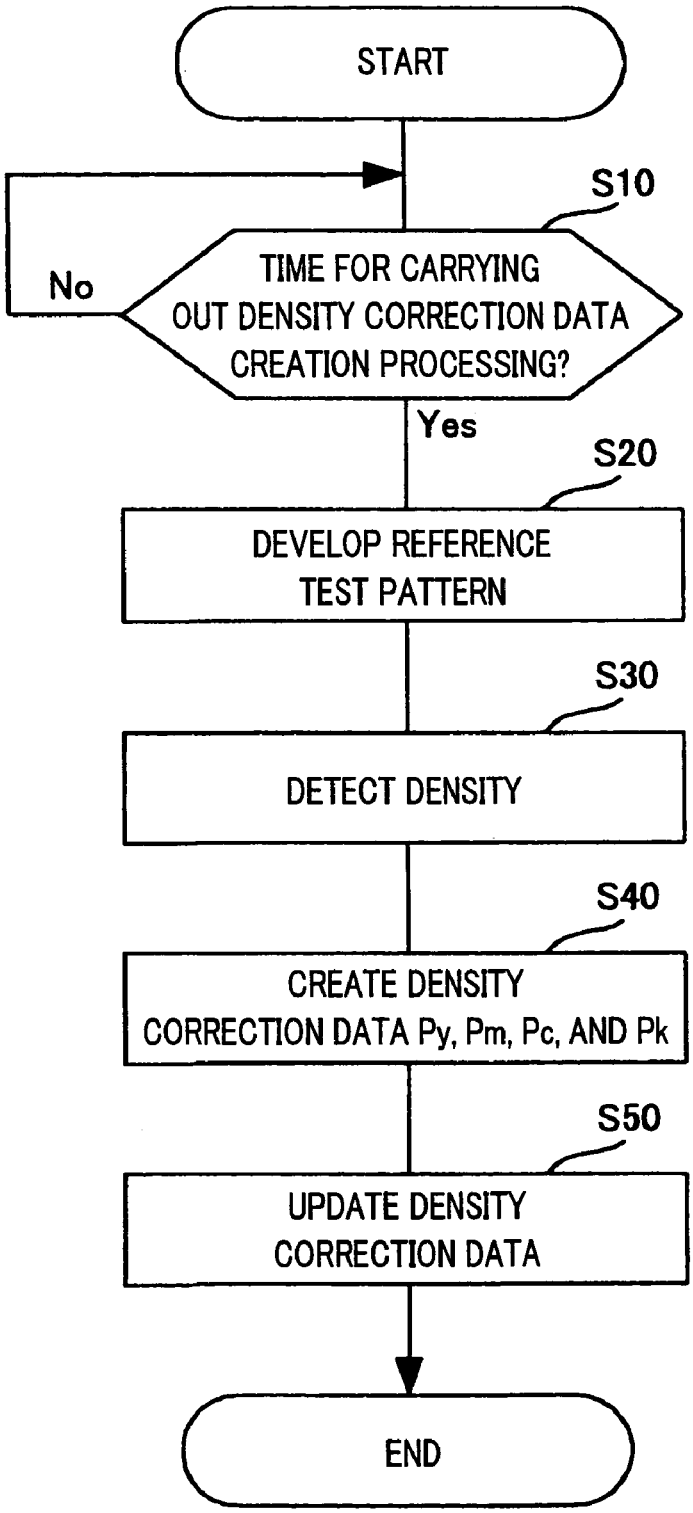
FIG. 5 is a flow chart that illustrates a procedure of a density correction data creation process performed by a CPU in the color copying machine X according to the embodiment of the present invention.

FIG. 1 is a block diagram that schematically illustrates a structure of a color copying machine X and a control system according to an embodiment of the present invention. FIG. 2 is a sectional view schematically illustrating an image formation section 10 of the color copying machine X. FIG. 3 is a view illustrating a reference test pattern and a tone expression of the reference test pattern. FIG. 4(*a*) and FIG. 4(*b*) are graphs that illustrate density correction data used in a density correction data process for photographic image data. FIG. 5 is a flow chart that illustrates a procedure of the density correction data creation process performed by a CPU in the color copying machine X according to the embodiment of the present invention.

With reference to FIGS. 1 and 2, followings briefly describe the structure of the color copying machine X (an image forming apparatus), to which a density correction data creation process (a density correction data creation method) according to the embodiment of the present invention is applied. The color copying machine X, which is a tandem engine color copying machine, includes a function of setting a print mode, and carries out printing in accordance with the print mode set manually or automatically. A concrete example of the print mode includes a mode in which a tone process appropriate for a category of a document image (text images, picture images, text/picture-mixed images, facsimile images (such as group 3 facsimiles (G3)) or the like) to be printed out is carried out before printing-out. More specifically, there are a text mode, a picture mode, a text/picture-mixed mode, a facsimile mode, and others, which correspond to the categories of the document images.

The color copying machine X is merely an example of an image forming apparatus, and other examples may be a monochrome copying machine, a printer, a facsimile, or a complex machine having functions of these machines. The present invention can be applied to these image forming apparatuses.

Followings briefly describe the structure of the color copying machine X, the control system, and the image formation section 10 in the color copying machine X, with reference to FIG. 1 and FIG. 2.

As shown in FIG. 1, the color copying machine X schematically includes a document reading section 40, an image process section 41, an image data storing section 43, an external image data input section 47, density sensor signal input section 46, an image editing section 45, an external interface (an external I/F) 48, an image formation section 10 (see FIG. 2), an engine control section 50, a data storing section 30, and a CPU (Central Process Unit) 44. The respective components are connected to a data bus 42 so as to be able to perform data communications.

The document reading section 40 reads images of documents. The external image data input section 47 inputs image data transferred from exterior devices.

The image formation section 10 includes a laser scanner unit (LSU) and a test pattern image formation section. The engine control section 50 controls the driving of the respective driving system units, such as the image formation section 10, of the color copying machine X. The data storing section 30 stores a reference test pattern 31 (later descried; see FIG. 3(*a*)) and various data, the reference test pattern 31 used in a density correction data creation process. The CPU 44 overall controls the respective components in accordance with a predetermined sequence program.

The document reading section 40 includes a color charge coupled device (CCD) 40*a* for three lines, a shading correction section (a shading correction circuit) 40*b*, a line adjustment section 40*c*, such as a line buffer, a sensor-color correction section (a sensor color correction circuit) 40*d*, a modulation transfer function (MTF) correction section (a modulation transfer function (MTF) correction circuit) 40*e*, and a gamma correction section (a gamma correction circuit) 40*f*.

The color charge coupled device (CCD) 40*a* for three lines reads an image (document image) of a monochrome or color document and separates the image into color components of RGB. Then, the CCD 40*a* outputs line data of RGB. The shading correction section 40*b* corrects line image levels of the line data of the respective colors RGB, the line data obtained from the document image that is read by the color charge coupled device (CCD) 40*a*. The line adjustment section 40*c* corrects misalignment in the line data of the respective colors RGB. The sensor-color correction section 40*d* corrects respective hues (color data) of the line data of the respective colors. The modulation transfer function (MTF) correction section (MTF correction circuit) 40*e* corrects so as to sharpen the changes of signals of the respective pixel. The gamma correction section 40*f* corrects lights and shades of images for visibility correction.

The image process section 41 includes at least a monochrome data creation section 41*a*, an input process section 41*b*, a region separation section 41*c*, a black generation section 41*d*, a color correction section (a color correction circuit) 41*e*, a zooming process section (a zooming process circuit) 41*f*, a spatial filter 41*g*, an halftone process section 41*h*, and a semiconductor processor (not illustrated), such as a digital signal processor (DSP), that causes the respective components to carry out the respective processes.

In a monochrome copying mode, the monochrome data creation section 41*a* creates monochrome data based upon RGB signals, which are color image signals inputted from the document reading section 40. The input process section 41*b* converts (i) RGB signals that are inputted in a full color copying mode, into (ii) YMC signals that are applicable to process units 11 (11*b*-11*d*) (see FIG. 2), each corresponding to the respective colors of YMC (yellow, magenta, and cyan), the process units 11 (11*b*-11*d*) included in the image formation section 10. The input process section 41*b* also carries out a clock conversion.

Followings briefly describe image process procedures that are carried out in the image process section 41 at a full color copying mode.

The image data that is converted from RGB signals into YMC signals by the input process section 41*b* is subsequently forwarded to the region separation section 41*c*. The region separation section 41*c* determines which category of image (for example, a text, a dot, a picture, a drawing, or others) is included in the image data, and then separates the image data into respective regions of each category. Examples of the regions include a letter region (a text region), a dot picture region, a photographic printing paper picture region, and others. Subsequently, the black generation section 41*d* carries out a ground color removal process for removing a ground color from the image data having been separated into the respective regions. At this time, a K (black) signal is generated based upon the YMC signals of the image data (a black generation process).

The thus created image data of the respective YMCK colors is forwarded to the color correction section (color correction circuit) 41*e* that follows the black generation section 41*d*. The color correction section 41*e* carries out a process (a density correction process) for correcting the printing density based upon the density correction data prepared for each print mode, thereby to conform density of printing (i.e. the density in which the image is to be printed) with the density of the input image that is inputted through the document reading section 40, the external image data input section 47, or the external interface 48. This density correction process is carried out for the respective YMCK colors. For the density correction process for the respective YMCK colors, the density correction data of one print mode contains density correction data of each color in an image that is to be printed out in that print mode, each color respectively corresponding to the YMCK colors. FIG. 4(*a*) illustrates an example of the density correction data used in the density correction process for a picture image data that are read in a picture mode. The respective Py, Pm, Pc, and Pk in FIG. 4(*a*) indicate density correction data of the respective YMCK colors. These sets of the density correction data are stored in a non-illustrated density correction data storing section in the color correction section 41*e*.

The density correction data stored in the density correction data storing section is updated (corrected) at a given timing. In other words, new density correction data is created, and the newly created density correction data replace the density correction data stored in the density correction data storing section. This process is carried out to solve the problem in that the density of the print image that are printed out based upon the image data to which the density correction process is carried out loses a conformity with the density of the input image (for example, a document image) due to various factors, such as changes over time in sensitivity characteristic of the photosensitive drums 101 (see FIG. 2) of the image formation section 10 or changes in environmental temperatures. The newly created density correction data is created by using the reference test pattern 31 (FIG. 3(*a*)) stored in the data storing section 30. This creation process (density correction data creation process) will be described below (see FIG. 5).

To the image data to which the density correction process is carried out by the color correction section 41*e*, a magnification conversion process corresponding to magnification preset by a user is carried out by the zooming process section (zooming process circuit) 41*f* that follows the color correction section 41*e*. After that, the image data is subjected to a filtering process by the spatial filter 41*g*, and subsequently to a halftone process (such as a multi-level error diffusion process or a multi-level dither method) by the halftone process section 41*h*. The halftone process expresses tones.

The image data to which the various processes are carried out by the respective components in the image process section 41 as mentioned above is then recorded in the image data storing section 43. The image data storing section 43 sequentially receives sets of image data of 8 bits each, which are serially outputted from the image process section 41 each set of image data respectively representing YMCK colors (i.e. totally 32 bits). Then, the image data is temporarily recorded them in a buffer of the image storing section 43 (the buffer is not illustrated here). The 32-bit image data temporarily stored in the buffer are read out in the order of storing are converted into sets of image data of 8 bits each for the four colors, and then are respectively recorded in four hard disks (rotation storage media) 43*a*, 43*b*, 43*c*, and 43*d*, each disposed for the respective colors.

At timing when the sets of image data (which are 8 bits each and respectively representing the four colors) stored in the hard disks 43*a* to 43*d* are to be outputted to an LSU 104 (mentioned later; see FIG. 2) in the image formation section 10, the image data of the respective colors are once stored in the buffer memory 43*e* (a semiconductor memory). After their output timing is adjusted to be different from each other, the sets of image data are outputted to the LSU 104 (104*a*-104*d*), each corresponding to the respective YMCK colors at different timings. This compensates a difference in the output timings due to a difference of positions of the respective image process units 11*a*-11*d*. Thereby misalignment of images sequentially transferred onto the intermediate transfer belt 12 is prevented.

The external interface (external I/F) 48 is a communication interface means that is connected to the color copying machine X and receives image data from an image input process unit, such as a communication portable terminal, a digital camera, a digital video camera, or an other device. Likewise, the image data that are inputted from this external I/F 48 are once inputted in the image process section 41, and the above-mentioned processes, such as the density correction process, the halftone process and the like, is carried out so that the image data are converted into a data level in which images can be created in the process unit 11 of the color copying machine X.

The external image data input section 47 is a printer interface/facsimile interface that receives image data created in an information process unit (such as a personal computer) or a facsimile unit, both of which are externally connected to the color copying machine X via a network or the like. Because the image data inputted from the external image data input section 47 is already converted into the YMCK signals which have been subjected to the above-mentioned processes such as the density correction process, the magnification conversion process, and the filtering process, the image data thus received go through only the intermediate process section 41*h*, and subsequently they are recorded and managed in the hard disks 43*a*, 43*b*, 43*c*, and 43*d* in the image data storing section 43.

The image editing section 45 performs a prescribed image editing process with respect the image data that has gone through the external image data input section 47, the image process section 41, or the external I/F 48, then been forwarded (or is inputted) to the image data storing section 43 and stored in the respective hard disks 43*a*-43*d*. This image editing process is carried out in a virtual drawing region on a memory (not illustrated) for combining images. The buffer memory 43*e* of the image data storing section 43 can be used as a memory for the image combining process.

Followings describe the image formation section 10, with reference to FIG. 1 and FIG. 2.

As schematically illustrated in the sectional view in FIG. 2, the image formation section 10 is provided with four process units 11 (11*a*-11*d*) that form full color images with developers of the respective YMCK colors, laser scanner units (LSU) 104 (104*a*-104*d*), an intermediate transfer belt 12, intermediate transfer rollers 13 (13*a*-13*d*), a fixing unit 14, and others. In addition, roughly speaking, the process units 11 are provided with photosensitive drums 101 (101*a*-101*d*) which are an example of a prescribed image bearing member, density sensors 15 (15*a*-15*d*) which are an example of an image density detection means, development units 102 (102*a*-102*d*), electrification units (charging units) 103 (103*a*-103*d*), a cleaning unit (not illustrated), and others.

The electrification units 103 are contact-type electrifiers that evenly electrify surfaces of the photosensitive drums 101 at a certain electric potential. When a laser beam emitted from the LSU 104 irradiates the surfaces of the photosensitive drums 101 that are electrified so as to have even electric potential, electrostatic latent images corresponding to the image data contained in (i.e. expressed by) the laser beam is formed on the photosensitive drums 101. The electrostatic latent images formed on the surfaces of the photosensitive drums 101 are developed (visualized) into toner images by the development units 102. After a later-described density correction data creation process is carried out, the toner images to be developed on the surfaces of the respective photosensitive drums 101 becomes toner images (reference test pattern images) corresponding to the reference test pattern 31 (see FIG. 3(*a*)) stored in the data storing section 30.

The density of the toner images formed on the surfaces of the photosensitive drums 101 by the development units 102 is detected by the density sensors 15 (see FIG. 2) disposed at a downstream part of the development units 102 in the rotation direction of the photosensitive drums 101. Concrete examples of such density sensors 15 encompass a diffused reflection-type optical sensor that detects the density of toner images by measuring a light volume of reflection lights irradiated on and reflected from the toner image or a specular reflection-type optical sensor. When a reflection light is received by the density sensors 15, a voltage signal corresponding to light intensity of the reflection light is generated and is sent to the density sensor signal input section 46.

The intermediate transfer belt 12 disposed below the photosensitive drums 101 is an endless belt having a loop like shape and being stretched in between a driving roller 12*a* and a driven roller 12*b*. The intermediate transfer rollers 13 (13*a*-13*d*), each paired with the respective photosensitive drums 101, are positioned across from the respective photosensitive drums 101 with respect to the intermediate transfer belt 12 interposed therebetween. In order to transfer a toner image supported (formed) on the surfaces of the photosensitive drums 101 onto the intermediate transfer belt 12, a transfer bias with a polarity opposite to the electrification polarity of the toner is impressed to the intermediate transfer roller 13. As a result, the toner images of the respective YMCK colors formed on the photosensitive drums 101 (101*a*-101*d*) are sequentially transferred, in piles, onto the periphery of the intermediate transfer belt 12 so as to be overlapped with each other. As a result, a full color toner image is formed on an outer surface of the intermediate transfer belt 12.

Followings describe the reference test pattern 31 stored in the data storing section 30, with reference to FIG. 3.

The reference test pattern 31 is used in a later-described density correction data creation process and is composed of density patterns prepared in accordance with the predefined density values $D_1$-$D_{16}$, as illustrated in FIG. 3(*a*). Here, a density pattern is a set of rectangular images arranged in line. Density values of the rectangular images are even within the rectangular images but are different from each other. The rectangular images having such density values are arranged in line in such a way in which the density values of the respective rectangular images gradually changes in order, from the palest to the darkest or from the darkest to the palest, as shown in FIG. 3(*a*). In addition, the reference test pattern 31 does not employ a pattern expressed with a tone expression of an image formed in the print mode (in other words, the reference test pattern 31 does not employ a tone expression of a halftone process that is for the print mode used in an actual printing process) but employs the one expressed in a distinctive tone expression different from tone expressions of images formed in any of the print modes the color copying machine X includes. For example, if a tone expression per pixel in a halftone process in a print mode is like a dot-arrangement tone expression 34, in which six dots are randomly dotted in a six-by-six matrix as illustrated in FIG. 3(*d*), an example of a dot-arrangement tone expression employable in the present invention is a dot-arrangement tone expression 32, in which six dots are put together in the substantially central section of a six-by-six matrix as illustrated in FIG. 3(*d*). Another example of the dot-arrangement tone expression employable in the present invention is a tone expression including a 12-by-12 matrix in which the tone expression in FIG. 3(*d*) is enlarged by a quadruple area ratio (double per side), as shown in FIG. 3(*c*), that is, a tone expression 33 in which the dot size is quadruply enlarged. Although any of the above tone expressions can express a predefined density, because the tone expression 34 among the three tone expressions 32, 33, and 34 can most naturally express a halftone, the tone expression 34 is used when a halftone is actually printed out. However, in the tone expression 34, the area of each dot is small. Therefore, even though an electrostatic latent image corresponding to the tone expression 34 is formed on the photosensitive drums 101, naturally, electric charge applied to the small dots would be little, and therefore the quantity of toner pulled (adhered) to the respective dots would widely vary. On the other hand, in the reference test pattern 31 expressed by the tone expressions 32 and 33, because the dot area is wide, electric charge applied to each dot would be large, and therefore the quantity of toner adhered to each dot would not widely vary. In the tone expressions 32 and 33 that are composed of large dots, a halftone is unnaturally expressed. However, counting of the dots and measuring of the density of the toner image of the reference test pattern 31 (reference test pattern image) will be less likely inaccurate, the toner image developed on the photosensitive drums 101 or the like. Thus, the reference test pattern image can have appropriate density in the tone expressions 32 and 33. Especially in the highlighted section, the quantity of adhering toner tends to vary among the dots due to an extremely small number of dots. By using the reference test pattern image, however, a precise density value of the halftone image can be obtained.

Followings describe a procedure of the density correction data creation process performed by the CPU 44 (FIG. 1) of the color copying machine X, with reference to FIG. 4(*b*) and with the flow chart in FIG. 5. The terms S10, S20 . . . in the Figure indicate a process procedure (step) number, and the procedure starts with the step S10. For simplification of description, explained below is only the Y-color density correction data creation process used in the density correction process of the Y-color image data contained in the picture image data read in the picture mode. Explanation on the procedures of the density correction data creation process of image data of the rest of the colors and of the rest of the print modes is omitted because it is the same as the process procedure of the Y-color image data. The term Qy in FIG. 4(*b*) indicates the detected density data of Y-color in the reference test pattern image, and the term Py' in FIG. 4(*b*) indicates new density correction data of Y-color.

First of all, in the step S10, it is determined whether it is the timing for carrying out the density correction data creation process. This determination is a determination process carried out by the CPU 44 of the color copying machine X, and the determination is done based upon whether or not a certain condition is detected. Examples of the certain condition are: whether or not the main power supply is switched on, whether or not a certain number of papers is printed out, and whether or not a photosensitive drum 101 (FIG. 2) is replaced. More specifically, the determination is done based upon whether or not a certain factor is detected. Examples of the certain factor are: an output signal from the power switch, a counting value of a counter of printed sheets, an output signal of a sensor that is disposed near a photosensitive drum 101 and detects installation/uninstallation of the photosensitive drum 101, and others. The determination of the step S10 is repeatedly done until the timing is detected.

When it is determined in the step S10 that it is the timing ('Yes' in S10), subsequently, the CPU 44 causes the image formation section 10 to develop the reference test pattern 31 (FIG. 3) on the photosensitive drums 101 (S20). In other words, the reference test pattern 31 stored in the data storing section 30 is read out by the CPU 44, and the read-out reference test pattern 31 is once temporarily stored in the buffer memory 43*e* and is subsequently forwarded to the image formation section 10 at each output timing of the respective YMCK colors.

After the toner images (reference test pattern images) of the respective colors in the reference test pattern 31 are developed respectively on the photosensitive drums 101 (101*a*-101*d*) by the development units 102 (102*a*-102*d*) in the image formation section 10, subsequently the density values of the reference test pattern image corresponding to the density values $D_1$-$D_{16}$ are detected by the density sensors 15 (15*a*-15*d*) disposed in a downstream of the development units 102 in a rotation direction of the photosensitive drums 101 (S30). Here, the detected density values of Y-color in the reference test pattern image corresponding to the density values $D_1$-$D_{16}$ (the horizontal axis in FIG. 4(*b*)) are indicated as $E_1$-$E_{16}$ (Qy) (the vertical axis in FIG. 4(*b*)).

Subsequently, in the step S40, new density correction data of Y-color, Py', that are to be used in the density correction process of the Y-color image data is created based upon the detected density values $E_1$-$E_{16}$ (Qy) detected by the density sensors 15*a* (see FIG. 4(*b*)). The correction data creation method will be specifically described below. Certainly, by carrying out the same process as the ones of the steps S20-S40, new density correction data of the respective MCK colors are also created. In addition, in the rest of the print modes, by carrying out the same process as the ones of the steps S20-S40, new density correction data of the respective colors can be created. Subsequently, in the step S50, the density correction data stored in the data storing section 30 are replaced by (updated with) the newly created density correction data.

A concrete example of the process of the step S40 may be a method in which the detected density values $E_1$-$E_{16}$ (Qy) detected by the density sensor 15*a* are multiplied by conversion factors $f_1$-$f_{16}$ so as to obtain Y-color density correction values $E_1$-$E_{16}$ (Py') corresponding to the density values $D_1$-$D_{16}$. The conversion factors $f_1$-$f_{16}$ are predefined for the Y-color in the picture image data. Here, the conversion factors $f_1$-$f_{16}$ are ratios of the Y-color density correction values $E_1$-$E_{16}$ (Py') to the detected density values $E_1$-$E_{16}$ (Qy). In other words, the Y-color density correction values $E_1$-$E_{16}$ (Py'), the detected density values $E_1$-$E_{16}$ (Qy), and the conversion factors $f_1$-$f_{16}$ fulfill the equation (1) presented below:

$$E_n(Py')=f_n\times E_n(Qy) \quad (1),$$

where n is an integer between 1 and 16.

Generally, the quantity of toner carried in the photosensitive drums 101 varies depending upon factors, such as changes of the sensitivity characteristic of the photosensitive drums 101, changes of environmental temperatures, or others. It has been known by experiments and research done by the inventors of the present invention over a long period of time that the variance rate of the quantity of toner does not greatly vary in different tone processes or in different print modes, and the quantity of toner always varies at a substantially constant variance rate. Therefore, for example, (i) the reference test pattern 31 is compared with (ii) a test pattern (picture-mode test pattern) to which a tone process in a picture mode has been carried out. The comparison is performed by comparing the density value of the toner image of the reference test pattern 31 with a density value of that toner image of the picture-mode test pattern whose density level corresponds to that of the toner image of the reference test pattern 31. In this way, a conversion factor $f_n$ is obtained. The Y-color density correction value $E_n$(Py') can be obtained by using the conversion factor $f_n$, the known density value $E_n$(Qy), and the equation (1). Obviously, it is necessary to precedently obtain superordinate conversion factors for all the print modes, for each tone process, or for each color.

Further, there might be a case in which it is more appropriate to obtain the Y-color density correction value $E_n$(Py') by adding/subtracting, to/from the known density value $E_n$(Qy), the density difference (the quantity of conversion correction) that can be obtained from the conversion factors $f_n$.

Further, if a conversion correction table that indicates the quantity of conversion correction for the density values $D_1$-$D_{16}$ is prepared in advance, the quantity of conversion correction can be easily obtained by looking up the conversion correction table. The quantity of conversion correction obtained in the foregoing way may be added/subtracted to the known a density value $E_n$(Qy) so as to obtain the Y-color density correction value $E_n$(Py').

Because new density correction data are created in the way foregoing describes, it is possible to create density correction data by forming only one reference test pattern 31 mentioned above on the photosensitive drums 101 or others, the density correction data being applicable to all the print modes and tone processes. In addition, conventionally a test pattern to be used in a density correction data creation process is formed on the photosensitive drums 101 or others after being subjected to a different halftone process for each print mode. On the other hand, in the present invention, because the test pattern 31 expressed in a tone expression (see FIG. 3) different from the ones of any print modes is used, the counting in dots and measuring the density of the toner image of the reference test pattern 31 (the reference test pattern image) will be less likely inaccurate, the toner image developed on the photosensitive drums 101 or others. Therefore, it becomes possible to use a test pattern from which an appropriate density value of the reference test pattern image can be obtained. Especially, because an accurate density value of the reference test pattern image of the highlighted section can be obtained, accurate density correction data can be created.

EXAMPLE

Followings describe an arrangement of a color copying machine X' (not illustrated) according to an example of the present invention, in which the density correction data creation process (FIG. 5) described in the above-mentioned embodiment is carried out. A significant difference between the arrangement of the color copying machine X' and that of the color copying machine X according to the above-mentioned embodiment is that the density correction data creation process is not carried out by the CPU 44: the aforementioned reference test pattern 31 is developed on the photosensitive drums 101 in accordance with a control command from the engine control section 50 that belongs to a control system independent from the CPU 44 (the step S20 in FIG. 5). Therefore, the engine control section 50 is provided with at least a storing section, such as a memory or a hard disk, that stores the reference test pattern 31 therein (FIG. 3) and a central process section, such as a DSP or a CPU. The central process section carries out a process for reading out the reference test pattern 31 from the storing section, and forwarding the read-out reference test pattern 31 to the LSU 104 of the image formation section 10 at the output timing for each color. In this arrangement, because the image formation section 10 that forms the reference test pattern 31 on the photosensitive drums 101 is controlled by the engine control section 50, the reference test pattern 31 can be transferred directly from the engine control section 50 to the LSU 104 without carrying out a complicated and cumbersome process, such as a process of bus-access to the data bus 42 or a process of transfer between the data storing section 30 and the buffer memory 43*e*. Therefore, it becomes possible to promptly carry out the process of developing the reference test pattern 31. In the color copying machine X' arranged in the previously described way, it is preferable that a signal indicating the timing be outputted from the CPU 44 to the engine control section 50 so as to detect the timing to carry out the density correction data creation process.

As described above, an image forming apparatus and creation method for creating density correction data according to the present invention are arranged such that one reference test pattern image expressed in a tone expression is formed on the predetermined image bearing member, the tone expression being different from a tone expression of an image formed in the print modes that carry out a normal print process, and density of the formed reference test pattern image is detected, and subsequently sets of density correction data for the print modes are created based upon the detected density.

With this arrangement, in which the test pattern image expressed in the tone expression in which inaccuracy less likely occurs (i.e. which allows more accurate detection), it becomes possible to increase the confidence level of the created density correction data and to achieve an appropriate density correction process.

Here, the reference test pattern image may be, for example, density image pattern established in accordance with the precedently prescribed density values. With this arrangement, density correction data is created which is segmentalized in accordance with the density values, and therefore the confidence level of the density correction data can be more increased.

Further, it is preferable that the tone expression be a dot arrangement/dot size expressing one pixel, more specifically that the reference test pattern image be expressed with a dot arrangement/dot size that is different from a dot arrangement/dot size used in the tone expression of an image formed in the print modes and can constrain inaccurate measurement of the copying density. This gives more options of tone expressions of a test pattern that can restrain variations of density. A concrete example of the tone expression of the test pattern may be a dot arrangement in which dots are concentrated in the substantial central part of a predefined-sized matrix. In addition, a dot size with a 2n-by-2n matrix may be used as a tone expression of the test pattern in place of the one with an n-by-n matrix expressed in the respective print modes or in any of the print modes.

Further, a concrete creation method of the density correction data may be, for example, a method in which the sets of density correction data are created by multiplying the detected density value of the reference test pattern image by conversion factors precedently predefined for the plurality of print modes. Different print modes employ different methods of a halftone process for input images. Therefore, it is usually necessary to establish density correction data for each print mode. It has been known by experiments and the like that although the density value of the reference test pattern image and the density values of images that are printed out in the respective print modes change as the time goes by, there is always a substantially constant prosection relationship between them. Therefore, by using the prosection relationship as a conversion factor, it becomes possible to create the sets of the density correction data for the print modes by using the density value of the reference test pattern image.

Further, if the prosection relationship is used as quantities of conversion correction, it becomes possible to easily create the sets of density correction data applicable to the print modes by adding/subtracting the quantities of conversion correction to/from the density value of the reference test pattern image, the quantities of conversion correction being precedently predefined for the plurality of print modes, and the density value of the reference test pattern image being detected by the image density detection section.

Further, it is preferable that the process in which the reference test pattern image is formed on the image bearing member be controlled by a main motor of the image forming apparatus, the main motor being controlled by an engine control section that directly controls the image formation section and other sections.

This arrangement enables the reference test pattern to be sent directly from the engine control section 50 to the image formation section by which the reference test pattern is to be developed. Therefore, the process of developing the reference test pattern can be promptly carried out.

As foregoing describes, in the present invention, one reference test pattern image expressed in a tone expression is formed on the predetermined image bearing member, the tone expression being different from a tone expression of an image formed in the print modes that carry out a normal print process, and density of the formed reference test pattern image is detected, and subsequently sets of density correction data for the print modes are created based upon the detected density. Therefore, the confidence level of the created density correction data can be improved by using the test pattern image expressed in the tone expression that allows the density to be detected more accurately. As a result, it becomes possible to carry out an appropriate density correction process to input images.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus in which sets of density correction data respectively for a plurality of print modes are created in accordance with a test pattern image supported on an image bearing member, the sets of density correction data being to be used in a density correction process for correcting a printing density to conform with density of an input image, the image forming apparatus comprising:

a test pattern image formation section for forming, on the image bearing member, one reference test pattern image expressed in a tone expression different from a tone expression of an image created in the plurality of print modes;

an image density detection section for detecting density of the one reference test pattern image formed by the reference test pattern image formation section; and a correction data creation section for creating the sets of density correction data based upon the density detected by the image density detection section.

2. An image forming apparatus as set forth in claim 1, wherein the one reference test pattern image is a density pattern image that is prescribed based upon a plurality of precedently predefined density values.

3. An image forming apparatus as set forth in claim 1, wherein the tone expression of the one reference test pattern image is at least one of (i) a dot arrangement that expresses one pixel and (ii) a dot size that expresses one pixel.

4. An image forming apparatus as set forth in claim 1, wherein the correction data creation section creates the sets of density correction data by multiplying a density value of the one reference test pattern image by conversion factors precedently predefined for the plurality of print modes, the density value of the one reference test pattern image being detected by the image density detection section.

5. An image forming apparatus as set forth in claim 1, wherein the correction data creation section creates the sets of density correction data by adding/subtracting quantities of conversion correction to/from the density value of the one reference test pattern image, the quantities of conversion correction being precedently predefined for the plurality of print modes, and the density value of the reference test pattern image being detected by the image density detection section.

6. An image forming apparatus as set forth in claim 1, wherein the tone expression in which the one reference test pattern image formed on the image bearing member by the test pattern image formation section is expressed is a tone expression which allows the density to be more accurately detected by the image density detection section than the tone expression of the created in the plurality of print modes.

7. An image forming apparatus as set forth in claim 1, wherein the tone expression in which the one reference test pattern image formed on the image bearing member by the test pattern image formation section is expressed is different from a tone expression of a halftone process that is applicable to a print mode used at a time when printing is actually processed.

8. An image forming apparatus as set forth in claim 1, wherein the tone expression in which the one reference test pattern image formed on the image bearing member by the test pattern image formation section is expressed is a tone expression whose dot size expressing a pixel is larger than that of a tone expression of a halftone process that is applicable to a print mode used at a time when printing is actually processed.

9. An image forming apparatus as set forth in claim 1, wherein the tone expression in which the one reference test pattern image formed on the image bearing member by the test pattern image formation section is expressed is a tone expression in which a dot arrangement expressing a pixel is more concentrated than that of a tone expression of a halftone process that is applicable to a print mode used at a time when printing is actually processed.

10. An image forming apparatus as set forth in claim 1, wherein the image bearing member is a photosensitive drum.

11. An image forming apparatus as set forth in claim 1, wherein the image density detection section is an optical sensor of a diffused reflection type or a specular reflection type.

12. An image forming apparatus as set forth in claim 1, wherein the test pattern image formation section is controlled by an engine control section that controls a driving system unit of the image forming apparatus.

13. A method for creating density correction data, the method being for use in an image forming apparatus in which sets of density correction data respectively for a plurality of print modes are created in accordance with a test pattern image supported on an image bearing member, the sets of density correction data being to be used in a density correction process for correcting a printing density to conform with density of an input image, the method comprising the steps of:

forming, on the image bearing member, one reference test pattern image expressed in a tone expression different from a tone expression of an image created in the plurality of print modes;

detecting density of the one reference test pattern image formed by the step of forming; and creating the sets of density correction data based upon the density detected by the step of detecting.

14. A method as set forth in claim 13, wherein the tone expression in which the one reference test pattern image formed on the image bearing member by the step of forming is expressed is different from a tone expression of a halftone process that is applicable to a print mode used at a time when printing is actually processed.

* * * * *